US011341934B2

(12) United States Patent
Lee et al.

(10) Patent No.: US 11,341,934 B2
(45) Date of Patent: May 24, 2022

(54) DISPLAY DEVICE AND IMAGE DISPLAY SYSTEM HAVING THE SAME

(71) Applicant: SAMSUNG DISPLAY CO., LTD., Yongin-si (KR)

(72) Inventors: Dong Gyu Lee, Yongin-si (KR); Ji Hye Kim, Yongin-si (KR); Jin Wook Yang, Yongin-si (KR); Jae Hyeon Jeon, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/162,138

(22) Filed: Jan. 29, 2021

(65) Prior Publication Data

US 2021/0398508 A1 Dec. 23, 2021

(30) Foreign Application Priority Data

Jun. 23, 2020 (KR) ..... 10-2020-0076716

(51) Int. Cl.
*G09G 5/36* (2006.01)
*G09G 3/20* (2006.01)

(52) U.S. Cl.
CPC ..... *G09G 5/363* (2013.01); *G09G 3/20* (2013.01); *G09G 2310/0267* (2013.01); *G09G 2310/0275* (2013.01); *G09G 2310/08* (2013.01)

(58) Field of Classification Search
CPC ..... G09G 5/006; G09G 2320/0233; G09G 2320/041; G09G 2320/103; G09G 5/363; G09G 3/3291; G09G 2310/027; G09G 3/3233; G09G 2300/0819; G09G 2310/08
See application file for complete search history.

(56) References Cited

U.S. PATENT DOCUMENTS 9,966,007 B2 5/2018 Cho et al.
10,376,786 B2 8/2019 Lee et al.
10,380,943 B2 * 8/2019 Choi ..... G09G 3/3233
(Continued)

FOREIGN PATENT DOCUMENTS

KR 1020170003849 A 1/2017
KR 1020170076478 A 7/2017
(Continued)

*Primary Examiner* — Gerald Johnson
(74) *Attorney, Agent, or Firm* — Cantor Colburn LLP

(57) ABSTRACT

An image display system includes a graphic processor which generates an image signal, a control signal, and a variable frequency signal; and a display device which displays an image at a frame frequency corresponding to the variable frequency signal from the graphic processor. The display device includes pixels connected to emission control lines, data lines, and scan lines; a controller which provides reference data including information on reference cycles, which are cycles in which an emission control start signal is output, to the graphic processor, outputs the emission control start signal based on the control signal, and adjusting an output timing of a scan start signal based on the variable frequency signal; an emission driver which supplies emission control signals to the emission control lines based on the emission control start signal; and a scan driver which supplies scan signals to the scan lines based on the scan start signal.

19 Claims, 9 Drawing Sheets

(56) References Cited

U.S. PATENT DOCUMENTS

| | | | | |
|---|---|---|---|---|
| 2012/0062613 | A1* | 3/2012 | Park | H04N 7/083 345/690 |
| 2017/0345395 | A1* | 11/2017 | Shim | G09G 5/12 |
| 2018/0330656 | A1* | 11/2018 | Kim | G09G 5/12 |
| 2018/0330671 | A1* | 11/2018 | Kim | G09G 3/3266 |
| 2019/0018454 | A1* | 1/2019 | Jung | H04M 1/0214 |
| 2019/0096330 | A1 | 3/2019 | Kim et al. | |
| 2019/0180695 | A1* | 6/2019 | Ha | G09G 3/3266 |
| 2019/0371250 | A1 | 12/2019 | Baek et al. | |
| 2021/0398490 | A1 | 12/2021 | Park et al. | |

FOREIGN PATENT DOCUMENTS

| | | | |
|---|---|---|---|
| KR | 1020180058279 | A | 6/2018 |
| KR | 1020190034375 | A | 4/2019 |
| KR | 1020190138718 | A | 12/2019 |
| KR | 1020210158457 | A | 12/2021 |

* cited by examiner

FIG. 8

| RC / # of EFLM | 2.08ms | | 1.67ms | | 1.39ms | | 1.19ms | |
|---|---|---|---|---|---|---|---|---|
| | Frame Time (ms) | Frequency (Hz) | Frame Time (ms) | Frequency (Hz) | Frame Time (ms) | Frequency (Hz) | Frame Time (ms) | Frequency (Hz) |
| 4 | 8.33 | 120.00 | | | | | | |
| 5 | 10.42 | 96.00 | 8.33 | 120.00 | | | | |
| 6 | 12.50 | 80.00 | 10.02 | 100.00 | 8.33 | 120.00 | | |
| 7 | 14.58 | 68.57 | 11.67 | 85.71 | 9.72 | 102.86 | 8.33 | 120.00 |
| 8 | 16.67 | 60.00 | 13.33 | 75.00 | 11.11 | 90.00 | 9.52 | 105.00 |
| 9 | 18.75 | 53.33 | 15.00 | 66.67 | 12.50 | 80.00 | 10.71 | 93.33 |
| 10 | 20.83 | 48.00 | 16.67 | 60.00 | 13.89 | 72.00 | 11.90 | 84.00 |
| 11 | | | 18.33 | 54.55 | 15.28 | 65.45 | 13.10 | 76.36 |
| 12 | | | 20.00 | 50.00 | 16.67 | 60.00 | 14.29 | 70.00 |
| 13 | | | | | 18.06 | 55.38 | 15.48 | 64.62 |
| 14 | | | | | 19.44 | 51.43 | 16.67 | 60.00 |
| 15 | | | | | 20.83 | 48.00 | 17.86 | 56.00 |
| 16 | | | | | | | 19.05 | 52.50 |
| 17 | | | | | | | 20.24 | 49.41 |

DISPLAY DEVICE AND IMAGE DISPLAY SYSTEM HAVING THE SAME

The application claims priority to Korean Patent Application No. 10-2020-0076716, filed on Jun. 23, 2020, and all the benefits accruing therefrom under 35 U.S.C. § 119, the content of which in its entirety is herein incorporated by reference.

BACKGROUND

1. Field

Embodiments of the invention relate to an image display system and an electronic device, and more particularly, to a display device and an image display system having the display device.

2. Description of the Related Art

A display device typically includes a pixel unit including a plurality of pixels and a driver for driving the pixel unit. The driver controls a display unit using an image signal applied from an external graphic processor to display an image.

A graphic processor renders raw data to generate the image signal. When rendering the raw data, a rendering time for generating the image signal corresponding to one frame may be changed according to the type or characteristics of the image. The driver may change the frame frequency in response to the rendering time.

SUMMARY

In a display device, when rendering time for generating an image signal corresponding to one frame does not match an output of an emission control signal according to a frame frequency, flicker may be visually recognized when the frame frequency is converted. When the rendering time is synchronized with the output of the emission control signal to prevent the flicker from being visually recognized, the number of applicable frame frequencies may be decreased.

An embodiment of the invention is directed to a display device in which an emission control signal and a scan signal are output at various frame frequencies synchronized with an input frequency of an image signal.

An embodiment of the invention is directed to an image display system including a graphic processor that outputs the image signal at a rendering speed corresponding to a frame frequency applicable to a display device, and the display device.

In an embodiment of the invention, an image display system includes a graphic processor which supplies an image signal, a control signal, and a variable frequency signal; and a display device which receives the image signal, the control signal and the variable frequency signal from the graphic process, and displays an image at a frame frequency corresponding to the variable frequency signal. In such an embodiment, the display device includes pixels connected to emission control lines, data lines, and scan lines; a controller which provides reference data including information on reference cycles, which are cycles in which an emission control start signal is output, to the graphic processor, outputs the emission control start signal based on the control signal, and adjusts an output timing of a scan start signal based on the variable frequency signal; an emission driver which supplies emission control signals to the emission control lines based on the emission control start signal; and a scan driver which supplies scan signals to the scan lines based on the scan start signal.

According to an embodiment, the control signal may include a data enable signal which separates an active period during which the image signal is supplied and a blank period within one frame.

According to an embodiment, the blank period may be an integer multiple of a selected one of the reference cycles. In such an embodiment, the control signal may be determined based on the selected one of the reference cycles.

According to an embodiment, a time length of the one frame may be an integer multiple of a selected one of the reference cycles.

According to an embodiment, the controller may include a receiver which restores a vertical synchronization signal based on the variable frequency signal; a memory in which the reference data is stored; and a control signal generator which selects a valid cycle corresponding to the frame frequency among the reference cycles from the reference data based on the data enable signal, and outputs the emission control start signal at the valid cycle.

According to an embodiment, the active period may be p times a time length of the valid cycle, where p is a positive integer, and the blank period may be q times the time length of the valid cycle, where q is an integer greater than or equal to 0.

According to an embodiment, the control signal generator may output the scan start signal in response to the vertical synchronization signal.

According to an embodiment, the vertical synchronization signal and the scan start signal may be output corresponding to the frame frequency.

According to an embodiment, the graphic processor may control a rendering speed for processing the image signal based on the reference data.

According to an embodiment, the graphic processor may select one of the reference cycles, and generate the control signal and the variable frequency signal based on a selected one of the reference cycles. In such an embodiment, an output frequency of the emission control signals may be an integer multiple of the frame frequency determined by the variable frequency signal.

According to an embodiment, the control signal may include information on the valid cycle and the blank period.

According to an embodiment, the control signal generator may detect the blank period, and determine a reference cycle corresponding to 1/r of a detected blank period as the valid cycle, where r is a positive integer.

According to an embodiment, the control signal generator may change the valid cycle of the emission control start signal based on changes in the variable frequency signal and the frame frequency.

According to an embodiment, when the blank period is not included in a current frame, the control signal generator may output the emission control start signal at the valid cycle of the emission control start signal output in a previous frame, where the valid cycle is selected among the reference cycles from the reference data based on the data enable signal to correspond to the frame frequency.

According to an embodiment, when the frame frequency is constant, the number of the emission control start signal supplied during one frame may be changed based the reference cycles.

According to an embodiment, the controller may further include an image data generator which rearranges the image signal into image data and outputs the image data corresponding to the frame frequency.

According to an embodiment, the display device may further include a data driver which converts the image data into data signals in analog format and supplies the data signals to the data lines.

In an embodiment of the invention, a display device includes pixels connected to emission control lines, data lines, and scan lines, where the pixels display an image at a frame frequency corresponding to a variable frequency signal based on a data enable signal; a controller which selects a valid cycle from reference cycles, which are cycles in which an emission control start signal is output, based on the data enable signal, outputs the emission control start signal at the valid cycle, and adjusts an output timing of a scan start signal based on the variable frequency signal; an emission driver which supplies emission control signals to the emission control lines based on the emission control start signal; and a scan driver which supplies scan signals to the scan lines based on the scan start signal.

According to an embodiment, the data enable signal may include an active period, during which an image signal is supplied, and a blank period in one frame, the active period may be p times a time length of the valid cycle, where p is a positive integer, and the blank period may be q times the time length of the valid cycle, where q is an integer greater than or equal to 0.

BRIEF DESCRIPTION OF THE DRAWINGS

The above and other features of the invention will become more apparent by describing in further detail embodiments thereof with reference to the accompanying drawings, in which:

FIG. 8 is a diagram illustrating an embodiment of frame frequencies applicable to the display device of the image display system of FIG. 1.

DETAILED DESCRIPTION

Figure 1:
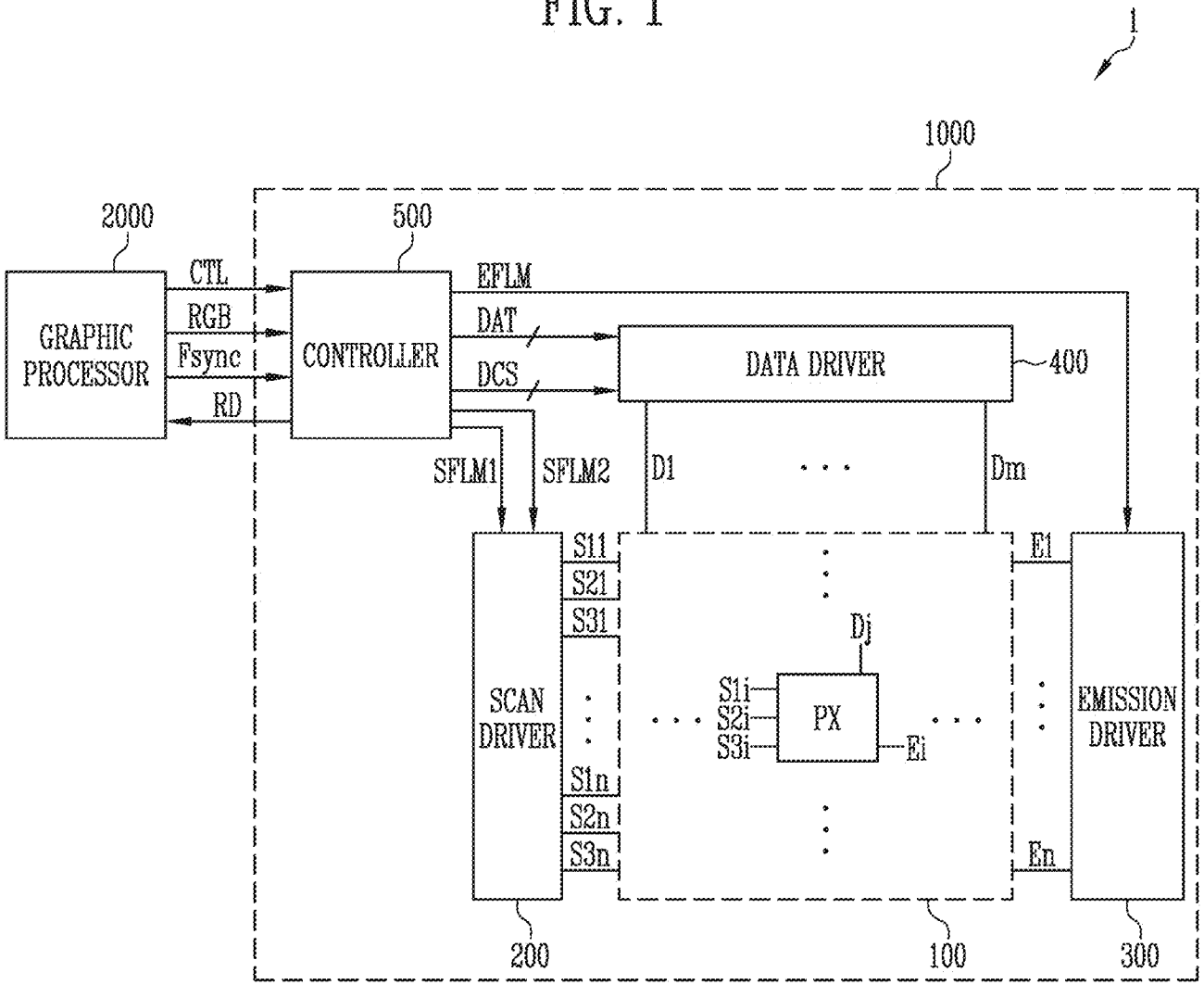
FIG. 1 is a block diagram illustrating an image display system according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a block diagram illustrating an image display system according to an embodiment of the invention.

Referring to FIG. 1, an embodiment of an image display system 1 may include a display device 1000 and a graphic processor 2000.

The graphic processor 2000 may supply an image signal RGB, a control signal CTL, and a variable frequency signal Fsync to the display device 1000. The graphic processor 2000 may generate the image signal RGB and the control signal CTL for controlling the display of the image signal RGB by processing raw data using a method such as a rendering.

The image signal RGB may include grayscale level information having luminance information on each pixel PX. In an embodiment, the image signal RGB may be supplied to a controller 500 from the graphic processor 2000 at a predetermined input frequency.

In an embodiment, the control signal CTL may include a data enable signal. The data enable signal may separate an active period, in which the image signal RGB or image data DAT is supplied, and a blank period in one frame. In such an embodiment, the control signal CTL may include information on a vertical synchronization signal and a horizontal synchronization signal. Timings of the vertical synchronization signal and the horizontal synchronization signal may be changed in response to the variable frequency signal Fsync. The vertical synchronization signal may classify the image signal RGB in units of frames, and the horizontal synchronization signal may classify the image signal RGB in units of horizontal lines (pixel rows).

In an embodiment, the control signal CTL may further include information related to the time length of the blank period.

The variable frequency signal Fsync may be a signal indicating frame frequencies of the image signal RGB and the control signal CTL provided from the graphic processor 2000 to the display device 1000, which may be changed every frame. The frame frequencies of the image signal RGB and the control signal CTL may be changed based on the rendering speed of the graphic processor 2000. In one embodiment, for example, the time taken to generate and supply the image signal RGB by processing the raw data corresponding to one frame may be changed.

In an embodiment, the graphic processor 2000 may control the rendering speed for processing the image signal RGB based on reference data RD supplied from the display device 1000. The reference data RD may include information on reference cycles, which are cycles in which an emission control start signal EFLM is output. In one embodiment, for example, the reference cycles of the emission control start signal EFLM may be set to 480 hertz (Hz) (output once per about 2.08 milliseconds (ms)), 600 Hz (output once per about 1.67 ms), or the like. However, this is merely exemplary, and the reference data RD may further include reference cycles of various spectrums applicable to the display device 1000.

The graphic processor 2000 may select one of the reference cycles and generate the control signal CTL and the variable frequency signal Fsync based on the selected one of the reference cycles. In one embodiment, for example, when a reference cycle of 480 Hz (or 2.08 ms) is selected, a period, during which the data enable signal included in the control signal CTL is supplied, and a period of one frame may be determined as an integer multiple of 2.08 ms.

In an embodiment, as shown in FIG. 1, the display device 1000 may include a pixel unit 100, a scan driver 200, an emission driver 300, a data driver 400, and the controller 500.

The pixel unit 100 may include scan lines S11 to S1*n*, S21 to S2*n*, and S31 to S3*n*, emission control lines E1 to En, data lines D1 to Dm, and pixels PX connected to the scan lines S11 to S1*n*, S21 to S2*n*, and S31 to S3*n*, the emission control lines E1 to En, and the data lines D1 to Dm, where m and n are integers greater than 1. Each pixel PX may include a driving transistor and a plurality of switching transistors.

The controller 500 may generate a data driving control signal DCS, the emission control start signal EFLM, a first scan start signal SFLM1, and a second scan start signal SFLM2 based on the control signal CTL and the variable frequency signal Fsync. The emission control start signal EFLM may be supplied to the emission driver 300, the first and second scan start signals SFLM1 and SFLM2 may be supplied to the scan driver 200, and the data driving control signal DCS may be supplied to the data driver 400.

In an embodiment, the first scan start signal SFLM1 may control a first scan signal supplied to first scan lines S11 to S1*n* and a second scan signal supplied to second scan lines S21 to S2*n*. The second scan start signal SFLM2 may control a third scan signal supplied to third scan lines S31 to S3*n*. However, this is merely exemplary, and the second scan signal may be controlled by a control signal different from the first scan start signal SFLM1.

In an embodiment, the controller 500 may provide the reference data RD including the information on the reference cycles to the graphic processor 2000, and output the emission control start signal EFLM based on the data enable signal included in the control signal CTL. In such an embodiment, the controller 500 may adjust the output timing of the emission control start signal EFLM based on the data enable signal.

In an embodiment, the controller 500 may supply the second scan start signal SFLM2 to the scan driver 200 at a same cycle as the emission control start signal EFLM.

The controller 500 may adjust the output timing of the first scan start signal SFLM1 based on the variable frequency signal Fsync and the vertical synchronization signal. In one embodiment, for example, the first scan start signal SFLM1 may control the first scan signal that controls a time point at which data is written to a pixel, and may be supplied once within one frame. In such an embodiment, the first scan start signal SFLM1 may control the second scan signal so that the second scan signal is output at a same cycle as the first scan signal.

The controller 500 may convert the image signal RGB into a form suitable for driving the display device 1000 and rearrange the image signal RGB to generate the image data DAT. The image data DAT may be supplied to the data driver 400.

In an embodiment, the scan driver 200 may receive the first scan start signal SFLM1 from the controller 500 and supply the first scan signal and the second scan signal to the first scan lines S11 to S1*n* and the second scan lines S21 To S2*n*), respectively, based on the first scan start signal SFLM1. In such an embodiment, the scan driver 200 may supply third scan signals to the third scan lines S31 and S3*n* based on the second scan start signal SFLM2.

The first to third scan signals may be set to a gate-on voltage (for example, a low voltage). A transistor of a pixel PX that receives the scan signal may be turned on when the scan signal is supplied.

The scan driver 200 may be disposed or mounted on a substrate through a thin film manufacturing process. FIG. 1 shows an embodiment in which a single scan driver supplies the first to third scan signals, but the invention is not limited thereto. In an alternative embodiment, the scan driver 200 may include a plurality of scan drivers that supply at least one of the first to third scan signals, respectively.

The emission driver 300 may supply an emission control signal to the emission control lines E1 to En based on the emission control start signal EFLM. In one embodiment, for example, the emission control signal may be sequentially supplied to the emission control lines E1 to En.

The emission control signal may be set to a gate-off voltage (for example, a high voltage). A transistor of a pixel PX that receives the emission control signal may be turned off when the emission control signal is supplied, and may be turned on in other cases.

The data driver 400 may receive the data driving control signal DCS and the image data DAT from the controller 500. The data driver 400 may convert the digital format image data DAT into an analog format data signal. The data driver 400 may supply the data signal (data voltage) to the data lines D1 to Dm in response to the data driving control signal DCS.

In an embodiment of the image display system 1 according to the invention, the graphic processor 2000 may generate the variable frequency signal Fsync and the control signal CTL based on the reference data RD generated by the controller 500. In such an embodiment, the controller 500 may control output cycles of the emission control start signal EFLM, the first scan start signal SFLM1, and the second scan start signal SFLM2 based on the variable frequency signal Fsync and the control signal CTL. Accordingly, the frequency at which the image signal RGB is supplied may be effectively synchronized with the output cycles of the emission control signal and the scan signals, such that flicker may be effectively prevented and/or substantially reduced when the frame frequency is changed.

Figure 2:
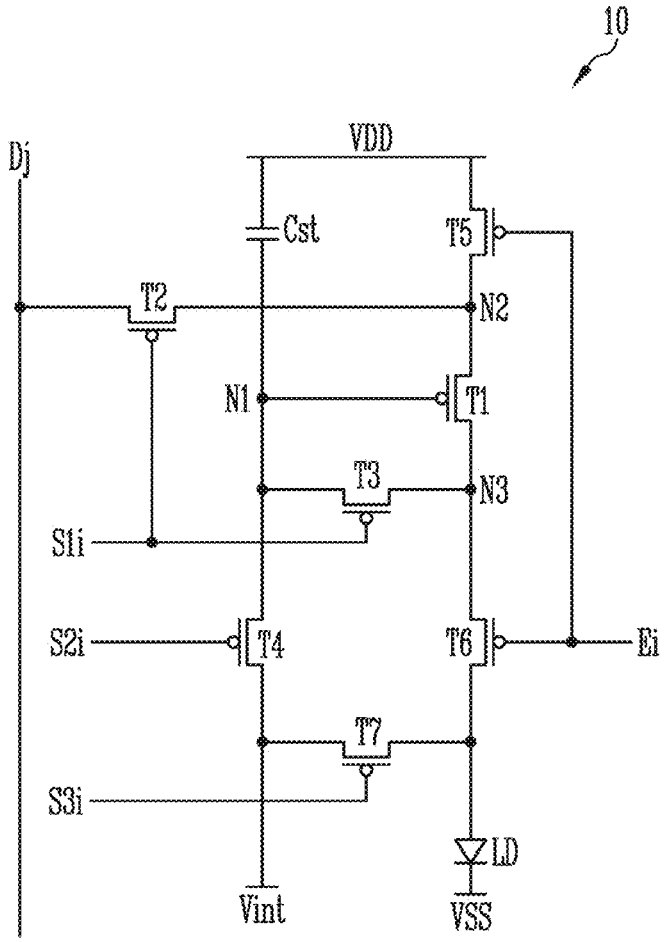
FIG. 2 is a circuit diagram illustrating an embodiment of a pixel included in a display device of the image display system of FIG. 1.

FIG. 2 is a circuit diagram illustrating an embodiment of a pixel included in a display device of the image display system of FIG. 1.

In FIG. 2, for convenience of illustration and description, a pixel 10 positioned on an i-th horizontal line (or an i-th pixel row) and connected to a j-th data line Dj, where i and j are natural numbers, is shown.

Referring to FIGS. 1 and 2, an embodiment of the pixel 10 may include a light emitting element LD, first to seventh transistors T1 to T7, and a storage capacitor Cst.

A first electrode (an anode electrode or a cathode electrode) of the light emitting element LD may be connected to the sixth transistor T6, and a second electrode (the cathode electrode or the anode electrode) of the light emitting element LD may be connected to a second power source VSS. The light emitting element LD may emit light with a luminance corresponding to an amount of current supplied from the first transistor T1.

In an embodiment, the light emitting element LD may be an organic light emitting diode including an organic light emitting layer. In an alternative embodiment, the light emitting element LD may be an inorganic light emitting element including or formed of an inorganic material. In another alternative embodiment, the light emitting element LD may be a light emitting element including or composed of an inorganic material and an organic material. Alternatively, the light emitting element LD may have a structure in which a plurality of inorganic light emitting elements are connected in parallel and/or in series between the second power source VSS and the sixth transistor T6.

The first transistor T1 (or a driving transistor) may be connected between a second node N2 and a third node N3. A gate electrode of the first transistor T1 may be connected to a first node N1. The first transistor T1 may control an amount of current (a driving current) flowing from a first power source VDD to the second power source VSS through the light emitting element LD based on a voltage of the first node N1. In such an embodiment, the first power source VDD may be set to a higher voltage than the second power source VSS.

The second transistor T2 may be connected between the j-th data line Dj (hereinafter, referred to as a data line) and the second node N2. A gate electrode of the second transistor T2 may be connected to an i-th first scan line S1*i* (hereinafter, referred to as a first scan line). The second transistor T2 may be turned on when the first scan signal is supplied to the first scan line S1*i* to electrically connect the data line Dj and the second node N2.

The third transistor T3 may be connected between the first node N1 and the third node N3. A gate electrode of the third transistor T3 may be connected to the first scan line S1*i*. The third transistor T3 may be turned on together with the second transistor T2.

The fourth transistor T4 may be connected between the first node N1 and an initialization power source Vint. A gate electrode of the fourth transistor T4 may be connected to an i-th second scan line S2*i* (hereinafter, referred to as a second scan line). The fourth transistor T4 may be turned on when the second scan signal is supplied to the second scan line S2*i* to supply a voltage of the initialization power source Vint to the first node N1.

The fifth transistor T5 may be connected between the first power source VDD and the second node N2. A gate electrode of the fifth transistor T5 may be connected to an emission control line Ei. The sixth transistor T6 may be connected between the third node N3 and the light emitting element LD. A gate electrode of the sixth transistor T6 may be connected to the emission control line Ei. The fifth transistor T5 and the sixth transistor T6 may be turned off when the emission control signal is supplied to the emission control line Ei, and may be turned on in other cases.

The seventh transistor T7 may be connected between the first electrode of the light emitting element LD and the initialization power source Vint. A gate electrode of the seventh transistor T7 may be connected to an i-th third scan line S3*i* (hereinafter, referred to as a third scan line). The seventh transistor T7 may be turned on by the third scan signal supplied to the third scan line S3*i* to supply the voltage of the initialization power source Vint to the first electrode of the light emitting element LD.

The storage capacitor Cst may be connected between the first power source VDD and the first node N1.

Figure 3:
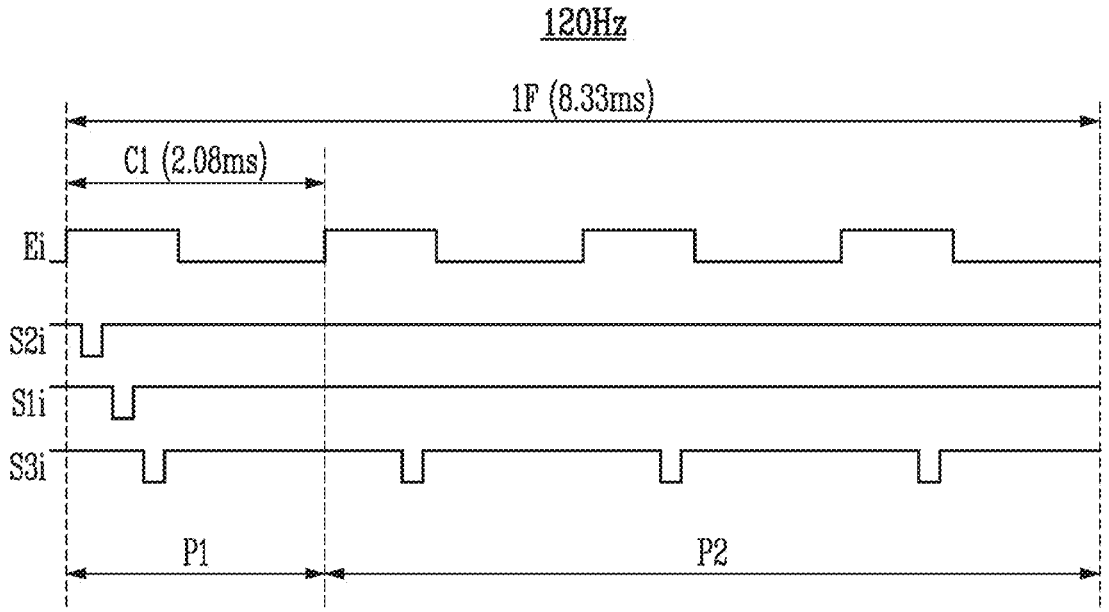
FIG. 3 is a timing diagram illustrating an embodiment of signals supplied to the pixel of FIG. 2.

FIG. 3 is a timing diagram illustrating an embodiment of signals supplied to the pixel of FIG. 2.

Referring to FIGS. 1, 2 and 3, an embodiment of the display device 1000 may supply the emission control signal multiple times to the emission control line Ei connected to the pixel 10 during one frame 1F.

In an embodiment, when the frame frequency is 120 Hz, one frame 1F is about 8.33 ms, and the emission control signal may be supplied four times during one frame 1F. In one embodiment, for example, the emission control signal may be supplied once in a first period P1 and three times in a second period P2. The third scan signal supplied to the third scan line S3*i* may be supplied to the pixel 10 at a same cycle as the emission control signal. Therefore, the emission control signal and the third scan signal may be supplied to the pixel 10 at 480 Hz. In such an embodiment, as shown in FIG. 3, a valid cycle C1 (or a first reference cycle), which is a cycle in which the emission control signal is supplied, may be about 2.08 ms corresponding to ¼ of 8.33 ms.

The first scan signal supplied to the first scan line S1*i* and the second scan signal supplied to the second scan line S2*i* may be supplied only in the first period P1. The first scan signal and the second scan signal may be supplied to the pixel 10 at 120 Hz.

A period in which the emission control signal has a low level (a period in which the emission control signal is not supplied) may be an emission period, and a period other than the emission period may be a non-emission period.

In the first period P1, the second scan signal, the first scan signal, and the third scan signal may be sequentially supplied to the second scan line S2*i*, the first scan line S1*i*, and the third scan line S3*i*, respectively, during the non-emission period, during which the light emission control signal is supplied.

During the non-emission period, the fourth transistor T4 may be turned on in response to the second scan signal. The voltage of the first node N1 may be initialized by turning on the fourth transistor T4.

Thereafter, the second and third transistors T2 and T3 may be turned on in response to the first scan signal. The data signal may be written to the pixel 10 by turning on the second and third transistors T2 and T3, and the first transistor T1 may be connected in the form of a diode. Accordingly, data writing and threshold voltage compensation may be performed.

Thereafter, the seventh transistor T7 may be turned on in response to the third scan signal. A voltage of the first electrode of the light emitting element LD may be initialized by turning on the seventh transistor T7.

Thereafter, the supply of the emission control signal may be stopped, and the fifth and sixth transistors T5 and T6 may be turned on so that the pixel 10 may emit light.

In the second period P2, the emission control signal and the third scan signal may be periodically supplied to the pixel 10. The pixel 10 may display an image corresponding to the data signal supplied in the first period P1 during one frame 1F.

The driving method of the pixel based on the timing diagram of FIG. 3 may correspond to various frame frequencies. That is, by adjusting the number of emission control signals supplied during one frame 1F, the frame frequency corresponding to the integer multiple of the valid cycle C1 may be synchronized with the emission control signal and the scan signals. In one embodiment, for example, according to the timing diagram of FIG. 3, when the rendering speed of the graphic processor 2000 corresponds to the frame frequency of 30 Hz, 40 Hz, 60 Hz, 120 Hz, or the like, the input timing at which the image signal RGB is input to the controller 500 may coincide with the output cycle of the emission control signal (and the scan signals) for driving the pixel unit 100.

However, when the rendering time and the frame frequency of the graphic processor 2000 are not the integer multiple of the valid cycle C1, the input timing of the image signal RGB may not coincide with the output cycle of the emission control signal. In one embodiment, for example, when the frame frequency is changed from 120 Hz to 51 Hz by the variable frequency signal Fsync, the time length of the emission period before and after the change of the frame frequency (that is, the time length of the period in which the emission control signal is not supplied) is changed, so that a change in luminance may occur and the flicker may be visually recognized.

In embodiments of the display device 1000 and the image display system 1 including the display device 1000 according to the invention, the controller 500 may include information on a plurality of reference cycles, and the input frequency of the image signal RGB supplied from the graphic processor 2000 to the display device may be limited to values corresponding to the reference cycles. Accordingly, the input frequency (for example, the cycle of the data enable signal or the rendering speed of the graphic processor 2000) for receiving the image signal RGB from the graphic processor 2000 may be effectively synchronized with the output cycles of the emission control signal (the emission control start signal EFLM) and the scan signals. Therefore, the flicker may not be visually recognized or may be substantially reduced when the frame frequency is converted.

Figure 4:
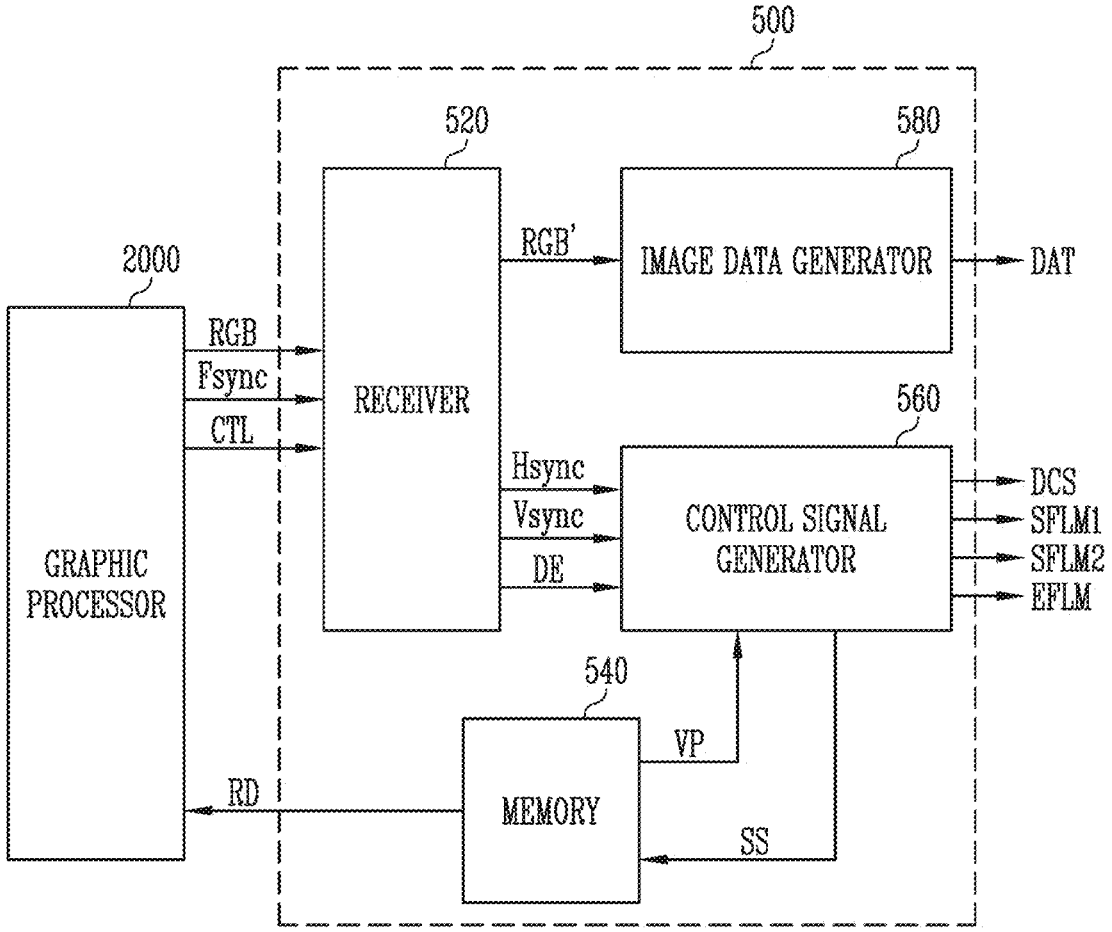
FIG. 4 is a block diagram illustrating an embodiment of a graphic processor and a controller included in the display device of the image display system of FIG. 1.

FIG. 4 is a block diagram illustrating an embodiment of a graphic processor and a controller included in the display device of the image display system of FIG. 1.

Referring to FIGS. 1 and 4, an embodiment of the controller 500 may include a receiver 520, a memory 540, a control signal generator 560, and an image data generator 580.

The receiver 520 may generate or restore a vertical synchronization signal Vsync and a horizontal synchronization signal Hsync from the control signal CTL based on the variable frequency signal Fsync. The vertical synchronization signal Vsync may be output at a cycle corresponding to the frame frequency.

In such an embodiment, the receiver 520 may generate or restore a data enable signal DE from the control signal CTL. The receiver 520 may receive the image signal RGB and transfer the image signal RGB' to the image data generator 580.

The memory 540 may store the reference data RD. The reference data RD may include the information on the reference cycles, which are cycles in which the emission control start signal EFLM may be output. The memory 540 may provide the reference data RD to the graphic processor 2000. In such an embodiment, a valid cycle VP may be read from the memory 540 in response to a selection signal SS supplied from the control signal generator 560.

In an embodiment, the memory 540 may be a non-volatile memory, in which stored information is not erased even when power supply is cut off. In one embodiment, for example, the memory may be implemented as an erasable programmable read-only memory ("EPROM"), an electrically erasable programmable read-only memory ("EEPROM"), a flash memory, or the like.

The control signal generator 560 may select the valid cycle VP corresponding to the frame frequency and the input frequency among the reference cycles from the reference data RD based on the data enable signal DE. The control signal generator 560 may read data corresponding to the valid cycle VP by supplying the selection signal SS corresponding to the valid cycle VP to the memory 540.

The valid cycle VP may be determined based on the time length of the data enable signal DE and the time length of the blank period of the data enable signal DE. In one embodiment, for example, the active period of the data enable signal DE may be p times the time length of the valid cycle VP (where p is a positive integer), and the blank period of the data enable signal DE may be q times the time length of the valid cycle VP (where q is an integer greater than or equal to 0).

In an embodiment, the control signal CTL may further include metadata having information on the blank period and information on the valid cycle VP. Accordingly, the control signal generator 560 may directly read the valid cycle VP from the memory using the metadata.

In an embodiment, the control signal generator 560 may detect the blank period from the data enable signal DE. The control signal generator 560 may determine the reference cycle corresponding to 1/r (where r is the positive integer) of the detected blank period as the valid cycle VP. In such an embodiment, the control signal generator 560 may further include hardware and/or software configuration for detecting the blank period.

The control signal generator 560 may output the emission control start signal EFLM at the valid cycle VP. The control signal generator 560 may output the second scan start signal SFLM2 at the valid cycle VP. In such an embodiment, the control signal generator 560 may generate the first scan start signal SFLM1 corresponding to a cycle of the vertical synchronization signal Vsync.

In an embodiment, the control signal generator 560 may generate the data driving control signal DCS for controlling the output timing of the data signal based on the vertical synchronization signal Vsync and the horizontal synchronization signal Hsync.

The image data generator 580 may rearrange the image signal RGB' from the receiver 520 and output the image data DAT corresponding to the frame frequency.

Figure 5:
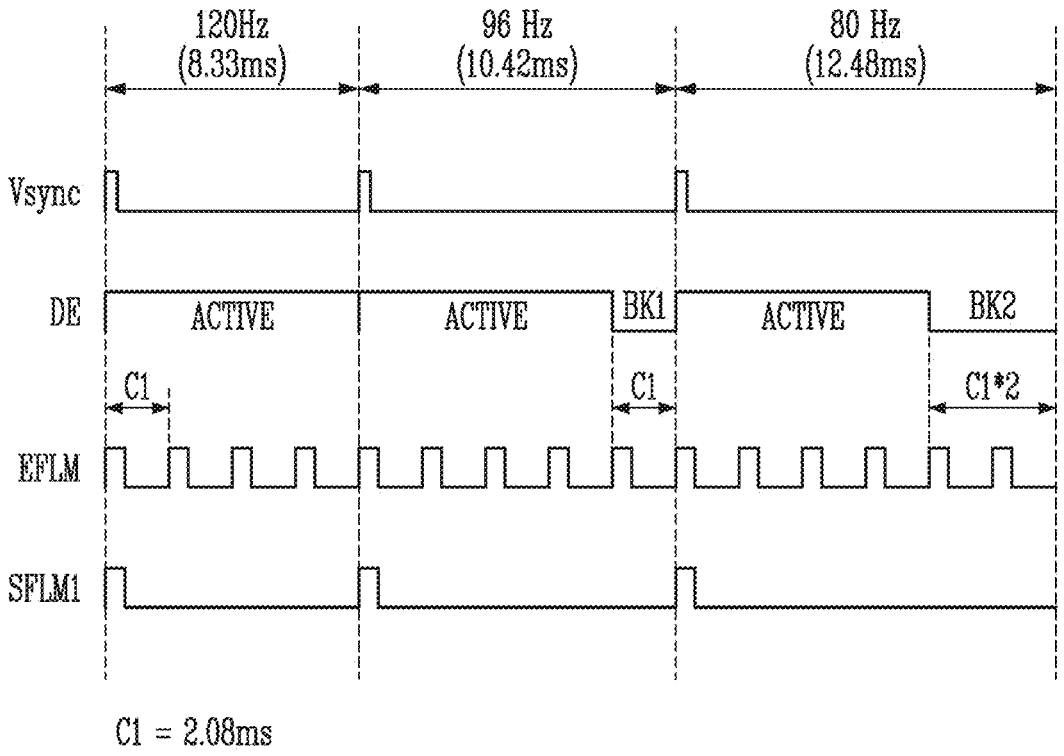
FIG. 5 is a timing diagram illustrating an embodiment of an operation of the controller of FIG. 4.

FIG. 5 is a timing diagram illustrating an embodiment of an operation of the controller of FIG. 4.

Referring to FIGS. 2 to 5, in an embodiment, the controller 500 may output the emission control start signal EFLM based on the data enable signal DE. In such an embodiment, the controller 500 may output the first scan start signal SFLM1 based on the vertical synchronization signal Vsync restored based on the variable frequency signal Fsync and the control signal CTL.

The data enable signal DE may include an active period ACTIVE and a blank period BK1 or BK2. The active period ACTIVE may be a period in which the image signal RGB is supplied to the controller 500 in one frame. The image signal RGB may not be supplied during the blank period BK1 or BK2.

In an embodiment, the graphic processor 2000 may determine the first reference cycle C1 (about 2.08 ms, that is, 480 Hz) among the reference cycles as the valid cycle VP. The graphic processor 2000 may determine frequencies corresponding to times of the integer multiple of the valid cycle VP as the frame frequency, and may render the image signal RGB in response to the determined frame frequency. In one embodiment, for example, as shown in FIG. 5, the frame frequency may be selected from about 120 Hz, about 96 Hz, about 80 Hz, or the like depending on the operation of the graphic processor 2000. The graphic processor 2000 may output the variable frequency signal Fsync and the data enable signal DE including information on the vertical synchronization signal Vsync corresponding to the selected frame frequency.

In the drawings and detailed description, the numerical values described as the reference cycle and the like may be understood as approximate values rounded to three decimal places.

In an embodiment, the controller 500 may output the emission control start signal EFLM at the valid cycle VP based on the data enable signal DE and the variable frequency signal Fsync. In one embodiment, for example, the first reference cycle C1 may be selected as the valid cycle VP.

When the frame frequency is about 120 Hz, the emission control start signal EFLM may be output four times (four cycles driving) within one frame.

When the frame frequency is about 96 Hz, the emission control start signal EFLM may be output five times (five cycles driving) within one frame. At this time, the first blank period BK1 may be substantially the same as the first reference cycle C1.

When the frame frequency is about 80 Hz, the emission control start signal EFLM may be output six times (six cycles driving) within one frame. At this time, the second blank period BK2 may be substantially the same as twice the time duration (time period or time length) of the first reference cycle C1.

In such an embodiment, when the valid cycle VP is the same, all active periods ACTIVE of the data enable signal DE may be the same as each other. In one embodiment, for example, when the first reference cycle C1 is the valid cycle VP, the active period ACTIVE may be the same as a period during which the emission control start signal EFLM is output four times.

In such an embodiment, as described above, when the first reference cycle C1 is determined as the valid cycle VP, the rendering time (for example, the active period ACTIVE) of the graphic processor 2000 may be fixed to a predetermined time, and the blank period BK1 or BK2 may be determined as the integer multiple of the first reference cycle C1. Therefore, the time length of one frame may coincide with the integer multiple of the first reference cycle C1.

As a result, when the frame frequency is converted based on the first reference cycle C1, the inputs of the data enable signal DE and the image signal RGB may be effectively synchronized with the output cycle of the emission control start signal EFLM. Therefore, the flicker may be effectively prevented and/or substantially reduced when the frame frequency is converted.

Figure 6:
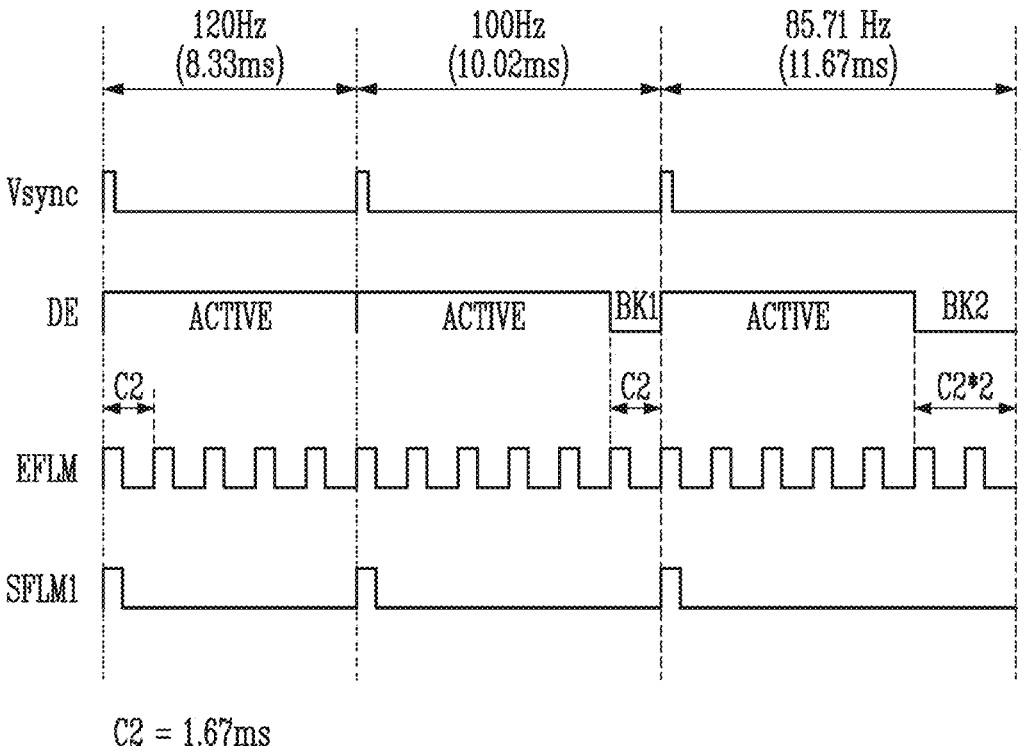
FIG. 6 is a timing diagram illustrating an alternative embodiment of the operation of the controller of FIG. 4.
Figure 7:
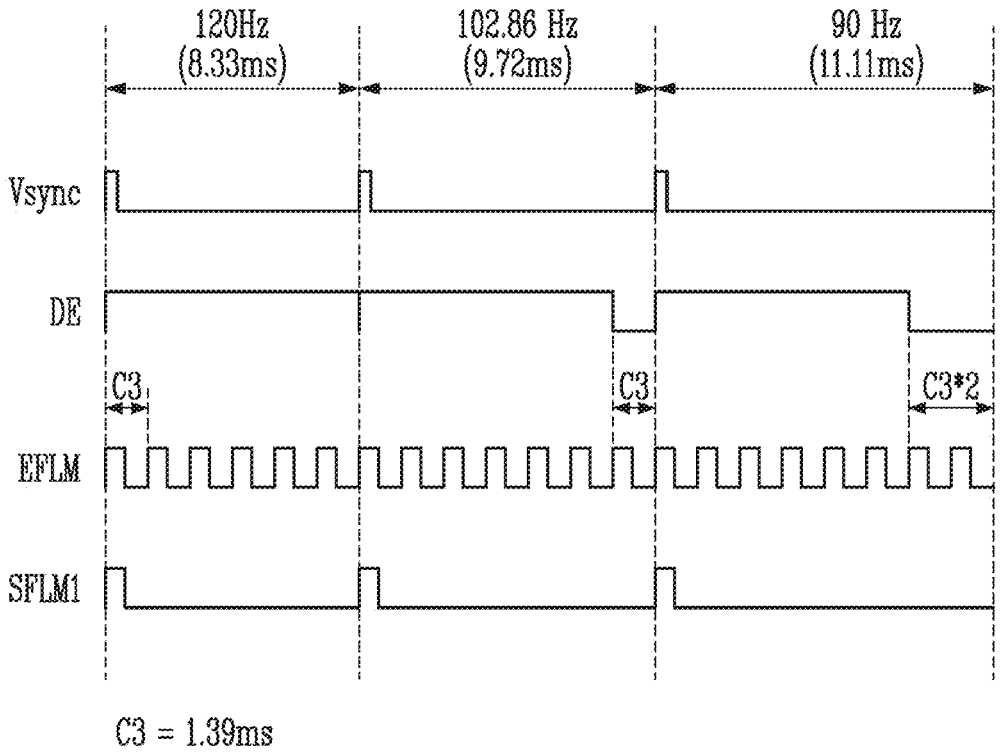
FIG. 7 is a timing diagram illustrating another alternative embodiment of the operation of the controller of FIG. 4.

FIG. 6 is a timing diagram illustrating an alternative embodiment of the operation of the controller of FIG. 4. FIG. 7 is a timing diagram illustrating another alternative embodiment of the operation of the controller of FIG. 4.

Referring to FIGS. 4 to 7, an embodiment of the controller 500 may output the emission control start signal EFLM based on the data enable signal DE.

In an embodiment, as shown in FIG. 6, a second cycle C2 (about 1.67 ms, that is, 600 Hz) may be determined as the valid cycle VP. The graphic processor 2000 may determine frequencies corresponding to times of the integer multiple of the valid cycle VP as the frame frequency, and may render the image signal RGB in response to the determined frame frequency. In one embodiment, for example, the frame frequency may be selected from about 120 Hz, about 100 Hz, about 85.71 Hz, or the like depending on the operation of the graphic processor 2000. The graphic processor 2000 may output the variable frequency signal Fsync and the data enable signal DE including the information on the vertical synchronization signal Vsync corresponding to the selected frame frequency.

In an embodiment, the controller 500 may output the emission control start signal EFLM at the valid cycle VP based on the data enable signal DE and the variable frequency signal Fsync.

When the frame frequency is about 120 Hz, the emission control start signal EFLM may be output five times (five cycles driving) within one frame.

When the frame frequency is about 100 Hz, the emission control start signal EFLM may be output six times (six cycles driving) within one frame. At this time, the first blank period BK1 may be substantially the same as the second reference cycle C2.

When the frame frequency is about 85.71 Hz, the emission control start signal EFLM may be output seven times (seven cycles driving) within one frame. At this time, the second blank period BK2 may be substantially the same as twice the time duration of the second reference cycle C2.

In an alternative embodiment, as shown in FIG. 7, a third cycle C3 (about 1.39 ms, that is, 700 Hz) may be determined as the valid cycle VP. When the frame frequency is about 120 Hz, the emission control start signal EFLM may be output six times (six cycles driving) within one frame. When the frame frequency is about 102.86 Hz, the emission control start signal EFLM may be output seven times (seven cycles driving) within one frame. At this time, the first blank period BK1 may be substantially the same as the third reference cycle C3. When the frame frequency is about 90 Hz, the emission control start signal EFLM may be output eight times (eight cycles driving) within one frame. At this time, the second blank period BK2 may be substantially the same as twice the time duration of the third reference cycle C3.

In such embodiments, as described above, when the frame frequency is converted based on a predetermined reference cycle, the inputs of the data enable signal DE and the image signal RGB may be effectively synchronized with the output cycle of the emission control start signal EFLM, such that the flicker may be effectively prevented and/or substantially reduced when the frame frequency is converted.

In such embodiments, as the number of times the emission control start signal EFLM is output is changed for a same frame frequency (for example, 120 Hz), the range of variable frame frequencies may be different from each other.

FIG. 8 is a diagram illustrating an embodiment of frame frequencies applicable to the display device of the image display system of FIG. 1.

Referring to FIGS. 5 to 8, the frame frequency of the display device may be variously determined based on the reference cycle RC and the number of times the emission control start signal EFLM is supplied in one frame.

FIG. 8 shows an embodiment in which the frame frequencies are changed discontinuously in a frequency range of 48 Hz to 120 Hz. In such an embodiment of the display device according to the invention, the frame frequencies may be converted into discrete values in units of frames. Such frequency conversion driving may be defined as discontinuous variable frame frequency driving.

In an embodiment, the emission control start signal EFLM may be supplied two or more times during one frame. In one embodiment, for example, as shown in FIG. 8, the number of times the emission control start signal EFLM is supplied in one frame may be determined in a range of 4 to 17 times. In such an embodiment, the time duration of one frame and the frame frequency may be determined by the number of times the emission control start signal EFLM is supplied in one frame and the reference cycle RC.

The time duration of one frame may be determined by multiplying the number of times the emission control start signal EFLM is supplied in one frame and the reference cycle RC. Therefore, the time duration of one frame may be the integer multiple of the reference cycle RC.

The graphic processor 2000 may set the active period ACTIVE and the blank period BK1 or BK2 of the data enable signal DE to integer multiples of the reference cycle RC, respectively, and render the image signal RGB in response to the data enable signal DE.

In such an embodiment, the controller 500 of the display device 1000 (shown in FIG. 1) may control the display of the image at various frame frequencies based on a plurality of reference cycles RC.

In one embodiment, for example, when the reference cycle RC is about 2.08 ms, the frame frequency may be changed to 7 or more frequencies. In an embodiment, when the reference cycle RC is about 1.67 ms, the frame frequency may be changed to 8 or more frequencies. When the reference cycle RC is about 1.39 ms, the frame frequency may be changed to 10 or more frequencies. When the reference cycle RC is about 1.19 ms, the frame frequency may be changed to 11 or more frequencies.

In an embodiment, as described above, even if the frame frequencies that overlap with each other between the reference cycles RC are excluded, in the frequency range of 48 Hz to 120 Hz, the frequencies in which the input frequency (rendering speed) of the image signal RGB is synchronized (or coincides) with the frame frequency of the display device 1000 (shown in FIG. 1) may be extended to 28 or more. Accordingly, in an embodiment of the display device 1000 (shown in FIG. 1) to which the discontinuous variable frame frequency driving is applied, the number of the frame frequencies, based on which the controller 500 operates, may be increased without the flicker being visually recognized. Therefore, versatility of the controller 500 applied to the display device 1000 (shown in FIG. 1) may be extended.

In an embodiment, as shown in FIG. 8, a predetermined frame frequency may be implemented by different reference cycles RC. In one embodiment, for example, when the display device is driven at the frame frequency of 120 Hz, the emission control start signal EFLM may be supplied four times at the reference cycle RC of about 2.08 ms, five times at the reference cycle RC of about 1.67 ms, six times at the reference cycle RC of about 1.39 ms, or seven times at the reference cycle RC of about 1.19 ms.

Figure 9:
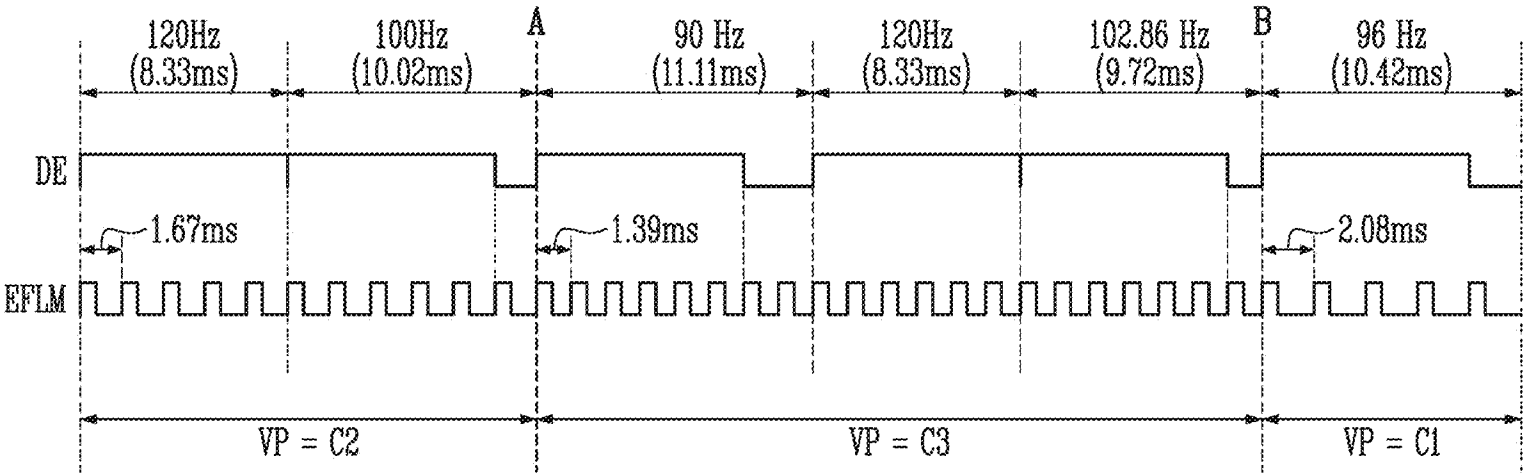
FIG. 9 is a timing diagram illustrating an embodiment of an operation of the image display system of FIG. 1.

FIG. 9 is a timing diagram illustrating an embodiment of an operation of the image display system of FIG. 1.

Referring to FIGS. 4 to 9, the control signal generator 560 included in the controller 500 may change the valid cycle VP of the emission control start signal EFLM according to changes in the variable frequency signal Fsync and the frame frequency.

In an embodiment, the graphic processor 2000 may supply the image signal RGB to the controller 500 at the input frequency based on the selected reference cycle RC. In one embodiment, for example, when the second reference cycle C2 of FIG. 6 is selected as the valid cycle VP, the time length of the data enable signal DE may be an integer multiple of the second reference cycle C2, and the frame frequency may be converted among frequencies corresponding to the integer multiple of the valid cycle VP.

In an embodiment, as shown in FIG. 9, the valid cycle VP may be changed at a first time point A. In one embodiment, for example, the valid cycle VP may be changed from the second reference cycle C2 to the third reference cycle C3. The control signal generator 560 may output the emission control signal EFLM and the first scan start signal SFLM1 based on the changed valid cycle VP and the data enable signal DE. Although not shown in FIG. 9, the first scan start signal SFLM1 for writing data may be output in synchronization with start points of the active period of the data enable signal DE.

When the valid cycle VP is changed, the frame frequency may be changed. In one embodiment, for example, as shown in FIG. 9, the frame frequency of 90 Hz, which may not be synchronized to the second reference cycle C2, may be implemented based on the third reference cycle C3.

In such an embodiment, the frame frequency of 96 Hz, which may not be synchronized to the second reference cycle C2 and the third reference cycle C3, may be implemented based on the first reference cycle C1. Therefore, the valid cycle VP at a second time point B may be determined as the first reference cycle C1, and the frame frequency may be effectively changed.

In an embodiment, when the blank period is not included in the current frame (for example, a section of 120 Hz shown in FIG. 9), the control signal generator 560 may output the emission control start signal EFLM at the valid cycle VP (for example, the third reference cycle C3) of the emission control start signal EFLM output in a previous frame.

In an embodiment, as shown in FIG. 8, various reference cycles RC may be applied to implement the frame frequency of 120 Hz without the blank period. In such an embodiment, when the valid cycle VP is selected in the control signal generator 560, an error may occur in terms of driving. However, as shown in FIG. 9, when the valid cycle VP of the previous frame is the third reference cycle C3, the control signal generator 560 may output the emission control start signal EFLM of the current frame at the third reference cycle C3. Accordingly, a driving error may be effectively prevented in the controller 500 by a relatively simple driving algorithm.

As set forth herein, in embodiments of the display device and the image display system including the display device according to the invention, the display device may include the information on the plurality of reference cycles, and the input frequency of the image signal supplied from the graphic processor to the display device may be limited to be selected from the values corresponding to the reference cycles. Therefore, the input frequency (that is, the rendering speed of the graphic processor) provided to the display device may be effectively or accurately synchronized with the output cycles (that is, the frame frequency) of the emission control signal (the emission control start signal) and the scan signals. In such embodiments, the flicker due to a change in emission time may not be visually recognized or may be substantially reduced when the frame frequency is converted.

In such embodiments, since the various reference cycles are preset, the number of the frame frequencies, based on which the controller of the display device operates, may be increased without the flicker being visually recognized, and the versatility of the controller applied to the display device may be extended.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. An image display system comprising:

a graphic processor which supplies an image signal, a control signal, and a variable frequency signal; and a display device which receives the image signal, the control signal and the variable frequency signal from the graphic process, and displays an image at a frame frequency corresponding to the variable frequency signal, wherein the display device comprises:

pixels connected to emission control lines, data lines, and scan lines;

a controller which provides reference data including information on reference cycles, in which an emission control start signal is output, to the graphic processor, outputs the emission control start signal based on the control signal, and adjusts an output timing of a scan start signal based on the variable frequency signal;

an emission driver which supplies emission control signals to the emission control lines based on the emission control start signal; and a scan driver which supplies scan signals to the scan lines based on the scan start signal.

2. The image display system of claim 1, wherein the control signal includes a data enable signal which separates an active period, during which the image signal is supplied, and a blank period in one frame.

3. The image display system of claim 2, wherein the blank period is an integer multiple of a selected one of the reference cycles, and the control signal is determined based on the selected one of the reference cycles.

4. The image display system of claim 2, wherein a time length of the one frame is an integer multiple of a selected one of the reference cycles.

5. The image display system of claim 2, wherein the controller comprises:

a receiver which restores a vertical synchronization signal based on the variable frequency signal;

a memory in which the reference data is stored; and a control signal generator which selects a valid cycle corresponding to the frame frequency among the reference cycles from the reference data based on the data enable signal, and outputs the emission control start signal at the valid cycle.

6. The image display system of claim 5, wherein the active period is p times a time length of the valid cycle, wherein p is a positive integer, and the blank period is q times the time length of the valid cycle, wherein q is an integer greater than or equal to 0.

7. The image display system of claim 5, wherein the control signal generator outputs the scan start signal in response to the vertical synchronization signal.

8. The image display system of claim 5, wherein the vertical synchronization signal and the scan start signal are output corresponding to the frame frequency.

9. The image display system of claim 5, wherein the graphic processor controls a rendering speed for processing the image signal based on the reference data.

10. The image display system of claim 9, wherein the graphic processor selects one of the reference cycles, and generates the control signal and the variable frequency signal based on a selected one of the reference cycles, and an output frequency of the emission control signals is an integer multiple of the frame frequency determined by the variable frequency signal.

11. The image display system of claim 10, wherein the control signal includes information on the valid cycle and the blank period.

12. The image display system of claim 5, wherein the control signal generator detects the blank period, and determines a reference cycle corresponding to lir of a detected blank period as the valid cycle, wherein r is a positive integer.

13. The image display system of claim 5, wherein the control signal generator changes the valid cycle of the emission control start signal based on changes in the variable frequency signal and the frame frequency.

14. The image display system of claim 2, wherein when the blank period is not included in a current frame, the control signal generator outputs the emission control start signal at a valid cycle of the emission control start signal output in a previous frame, wherein the valid cycle is selected among the reference cycles from the reference data based on the data enable signal to correspond to the frame frequency.

15. The image display system of claim 2, wherein when the frame frequency is constant, the number of the emission control start signal supplied during one frame is changed based on the reference cycles.

16. The image display system of claim 1, wherein the controller further comprises:

an image data generator which rearranges the image signal into image data and outputs the image data corresponding to the frame frequency.

17. The image display system of claim 16, wherein the display device further comprises:

a data driver which converts the image data into data signals in an analog format and supplies the data signals to the data lines.

18. A display device comprising:

pixels connected to emission control lines, data lines, and scan lines and displaying an image at a frame frequency corresponding to a variable frequency signal based on a data enable signal;

a controller which selects a valid cycle from reference cycles, in which an emission control start signal is output, based on the data enable signal, outputs the emission control start signal at the valid cycle, and adjusts an output timing of a scan start signal based on the variable frequency signal;

an emission driver which supplies emission control signals to the emission control lines based on the emission control start signal; and a scan driver which supplies scan signals to the scan lines based on the scan start signal.

19. The display device of claim 18, wherein the data enable signal includes an active period, during which an image signal is supplied, and a blank period in one frame, the active period is p times a time length of the valid cycle, wherein p is a positive integer, and the blank period is q times the time length of the valid cycle, wherein q is an integer greater than or equal to 0.

* * * * *